US006631831B1

(12) United States Patent
Loiselle

(10) Patent No.: US 6,631,831 B1
(45) Date of Patent: Oct. 14, 2003

(54) SELF-CLEANING HAIRBRUSH SYSTEM

(76) Inventor: David J. Loiselle, 14130 Josephine Rd., Largo, FL (US) 33774

( * ) Notice: Subject to any disclaimer, the term of this patent is extended or adjusted under 35 U.S.C. 154(b) by 89 days.

(21) Appl. No.: 10/050,753

(22) Filed: Jan. 16, 2002

Related U.S. Application Data

(60) Provisional application No. 60/326,402, filed on Oct. 2, 2001.

(51) Int. Cl.[7] ..... A45D 24/42

(52) U.S. Cl. ..... 222/119; 222/228; 222/272; 222/123; 15/169; 15/184; 15/203

(58) Field of Search ..... 132/120, 121, 132/122, 123, 147, 119, 237–240, 228, 272; 15/169, 184, 203

(56) References Cited

U.S. PATENT DOCUMENTS 4,028,768 A * 6/1977 Pascal ..... 15/203
4,473,086 A * 9/1984 Thaler et al. ..... 132/229
4,971,081 A * 11/1990 Seja et al. ..... 132/121

* cited by examiner

*Primary Examiner*—Kevin Shaver
*Assistant Examiner*—Stephanie Willatt
(74) *Attorney, Agent, or Firm*—Edward P. Dutkiewicz

(57) ABSTRACT

A self-cleaning hairbrush system has a housing with a wall formed with apertures and with a hollow interior with an open end and a closed end. A core has an interior end positionable adjacent to the closed end and an exterior exposed end extending through the open end of the housing. A plurality of resilient bristles have fixed ends extending radially outward from the core and free ends extending through the apertures of the housing. A handle is operatively coupled to the closed end of the housing.

15 Claims, 6 Drawing Sheets

FIG 1
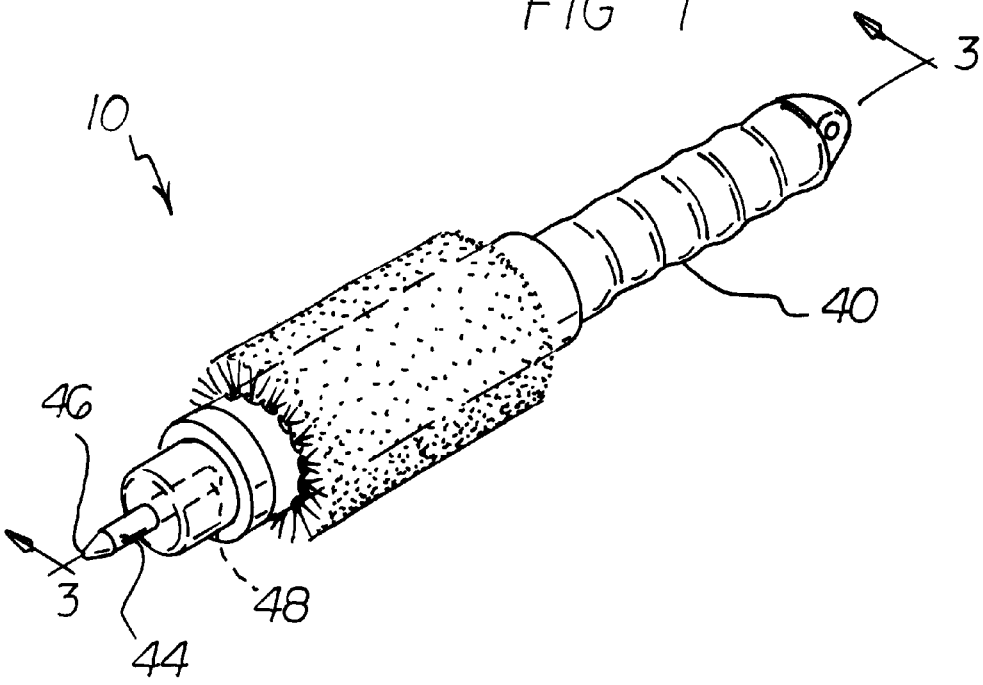
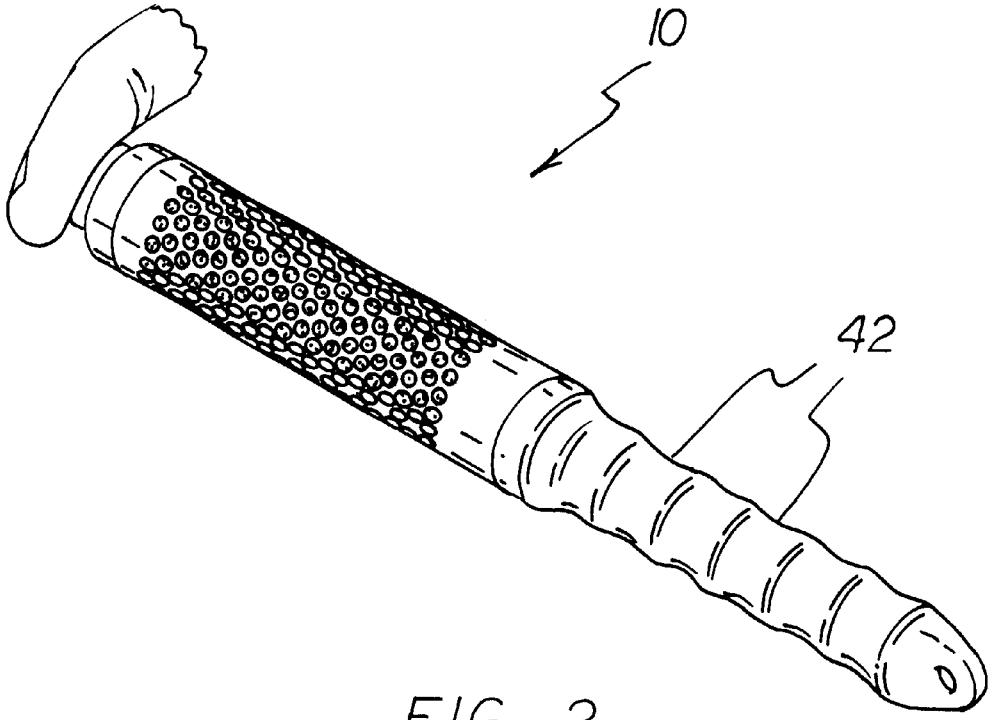
FIG 2

FIG 3
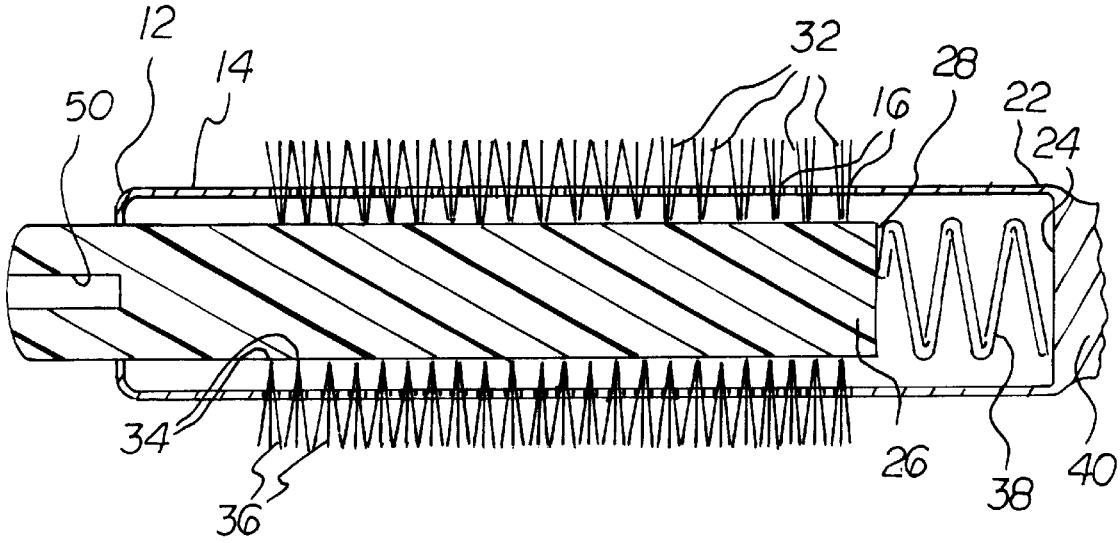
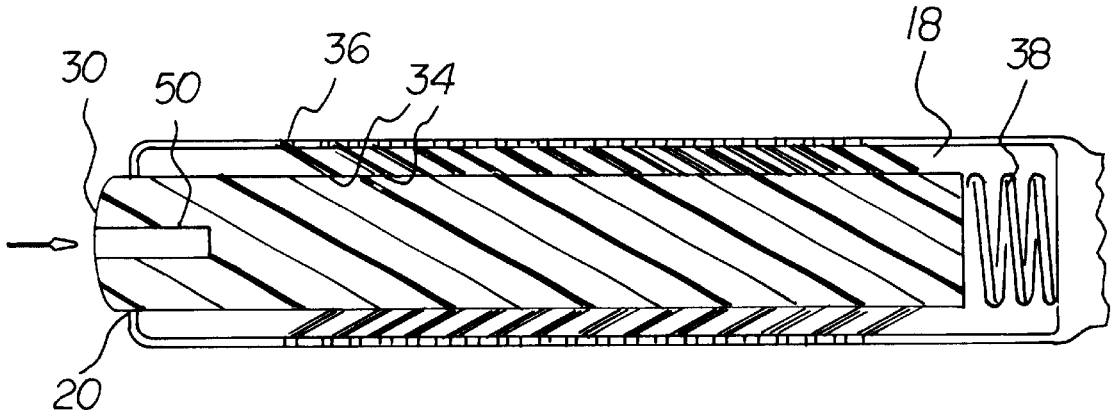
FIG 4

FIG 5
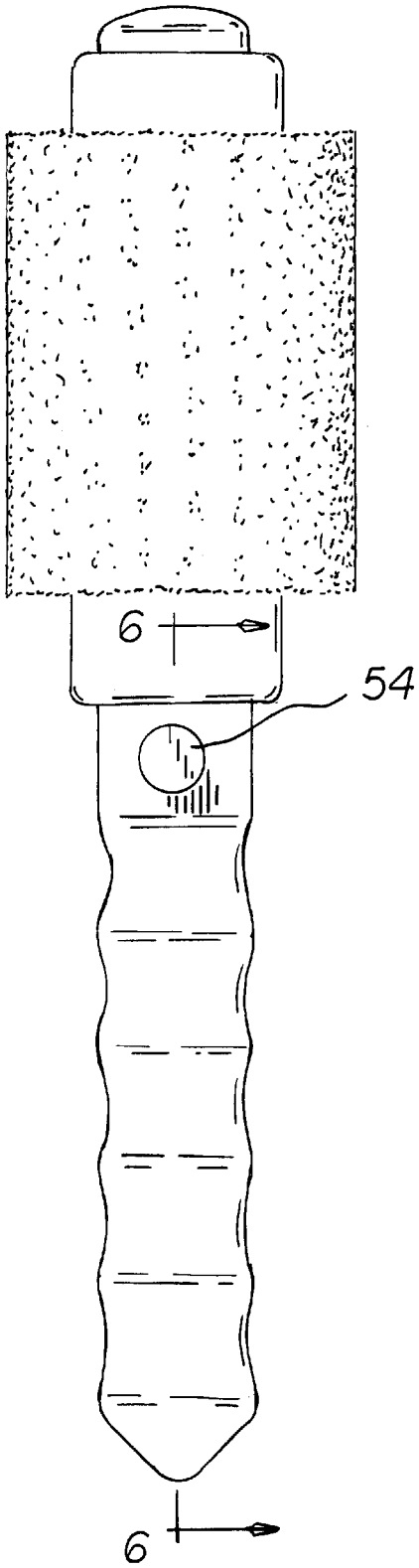
FIG 6
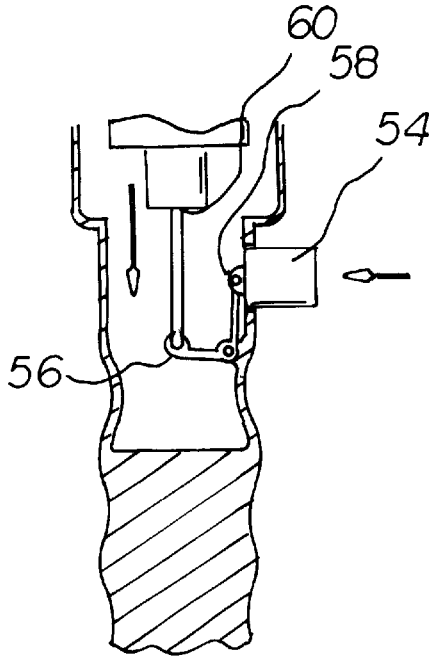
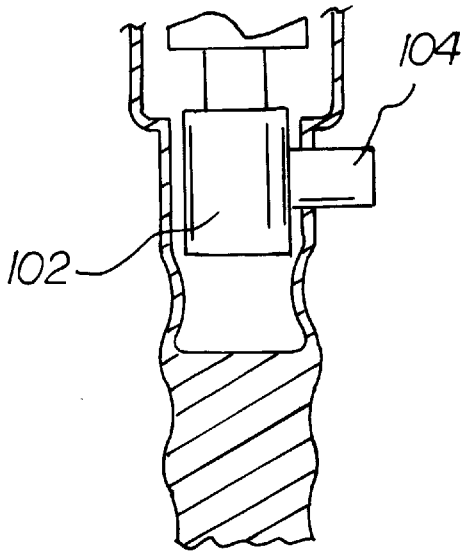
FIG 11

FIG 9
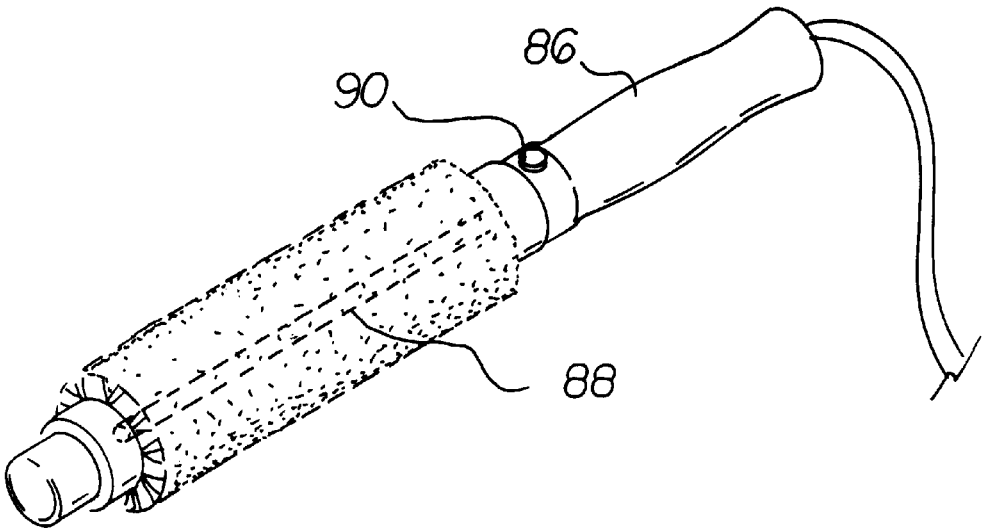
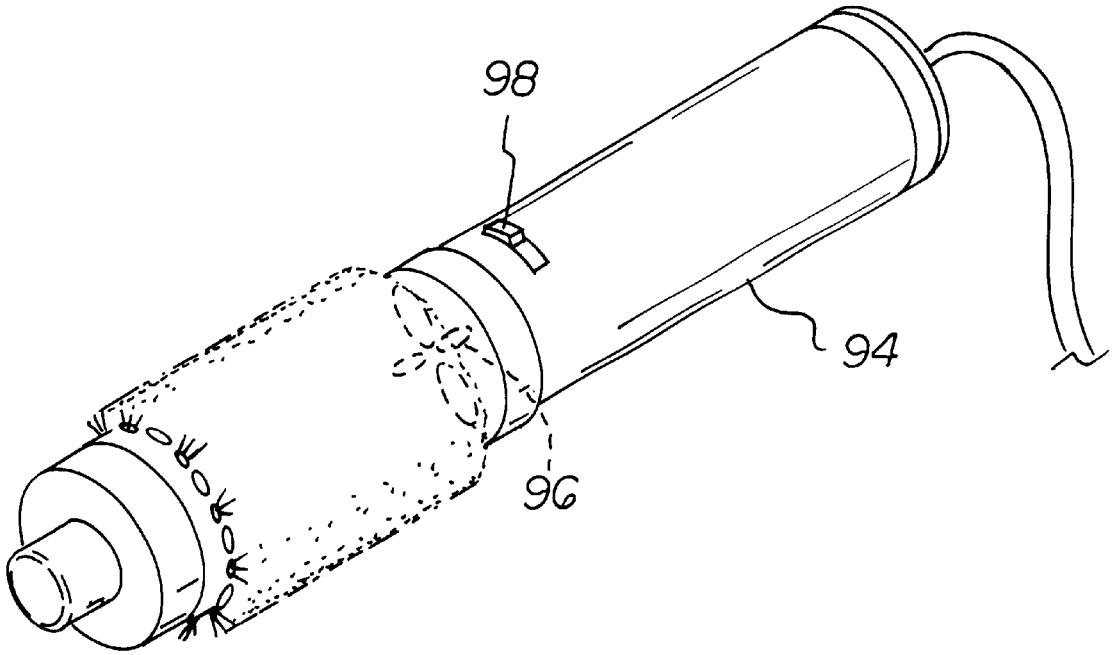
FIG 10

FIG 12
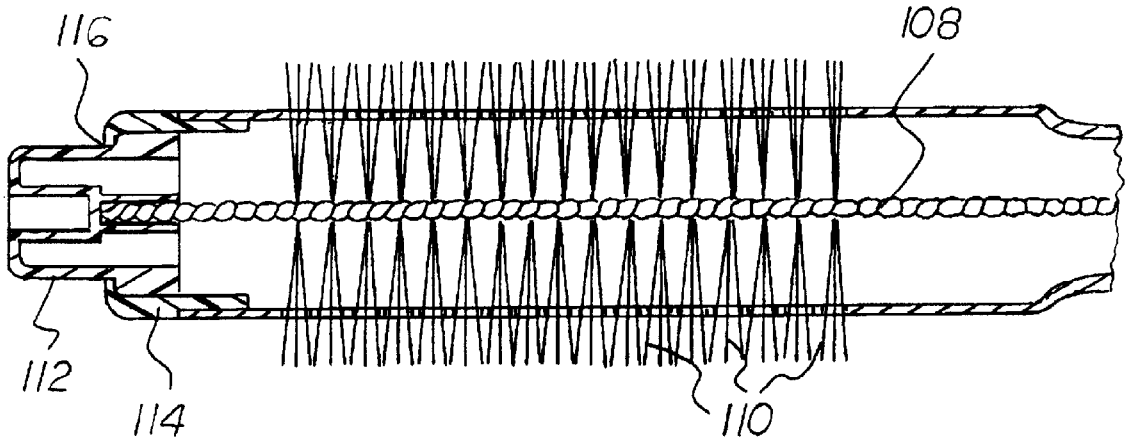
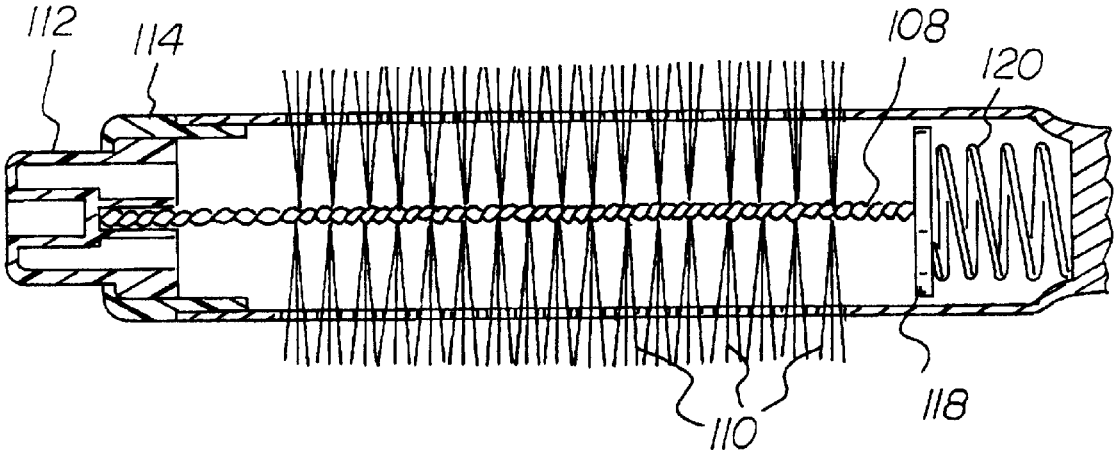
FIG 13

SELF-CLEANING HAIRBRUSH SYSTEM

RELATED APPLICATION

The present application is a continuation in part of provisional application Ser. No. 60/326,402 filed Oct. 2, 2001.

BACKGROUND OF THE INVENTION

1. Field of the Invention

The present invention relates to a self-cleaning hairbrush system and more particularly pertains to automatically removing hair from the bristles of a hairbrush in a thorough and convenient manner.

2. Description of the Prior Art

The use of brushes with self-cleaning capabilities of known designs and configurations is known in the prior art. More specifically, brushes with self-cleaning capabilities of known designs and configurations previously devised and utilized for the purpose of cleaning matter from the bristles of brushes through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,862,563 to Hartmann discloses a self-cleaning brush. U.S. Pat. No. 4,084,282 to Calvert discloses a rotary brush for removing hair from hair brushes. U.S. Pat. No. 3,110,053 to Surabian discloses a hairbrush. Lastly, U.S. Pat. No. 3,172,139 to Wire discloses a hairbrush.

While these devices fulfill their respective, particular objectives and requirements, the aforementioned patents do not describe a self-cleaning hairbrush system that allows automatically removing hair from the bristles of a hairbrush in a thorough and convenient manner. This action will remove some hair from the bristles and transfer other hair to the tips of the bristles so that it may be more easily removed.

In this respect, the self-cleaning hairbrush system according to the present invention substantially departs from the conventional concepts and designs of the prior art, and in doing so provides an apparatus primarily developed for the purpose of automatically removing hair from the bristles of a hairbrush in a thorough and convenient manner.

Therefore, it can be appreciated that there exists a continuing need for a new and improved self-cleaning hairbrush system which can be used for automatically removing hair from the bristles of a hairbrush in a thorough and convenient manner. In this regard, the present invention substantially fulfills this need.

SUMMARY OF THE INVENTION

In view of the foregoing disadvantages inherent in the known types of brushes with self-cleaning capabilities of known designs and configurations now present in the prior art, the present invention provides an improved self-cleaning hairbrush system. As such, the general purpose of the present invention, which will be described subsequently in greater detail, is to provide a new and improved self-cleaning hairbrush system and method which has all the advantages of the prior art and none of the disadvantages.

To attain this, the present invention essentially comprises a housing. The housing is fabricated of a rigid material, metal or plastic, in a generally cylindrical configuration. The housing has a wall formed with apertures and has a hollow interior with an open end and a closed end. The closed end provides a circular abutment surface. Next provided is a core. The core may be fabricated of a twisted wire or of generally rigid material, preferably plastic, in a cylindrical configuration. The core has an interior end positionable adjacent to the abutment surface. The core also has an exterior exposed end extending through the open end of the housing. A plurality of resilient nylon bristles are next provided. The bristles have fixed ends extending radially outward from the core. The bristles also have free ends extending through the apertures of the housing for use in brushing a person's hair or animal's hair. Next provided is a coil spring. The coil spring is positioned within the housing, between the core and the abutment surface. The spring has an extended orientation wherein the bristles extend radially outwardly from the core and through the apertures of the housing. The spring has a compressed orientation achieved through the depression of the exterior exposed end of the core toward the housing. In this manner, the bristles are withdrawn through the apertures of the housing so that the extraneous hair and other matter located in the bristles will be stripped therefrom as the bristles are moved inwardly through the apertures and cleaned. A handle is next provided. The handle is coupled to the closed end of the housing and extends coaxially with the housing and core in a direction away from the core for being held by a user during operation and use. The handle has annular indentations for facilitating the grasping thereof by a user. Finally, a styling tip is provided. The styling tip is in a cone-shaped configuration with a free pointed end and a cylindrical end. A cylindrical recess is provided in the exterior end of the core for removable receipt of the tip.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved self-cleaning hairbrush system which has all of the advantages of the prior art brushes with self-cleaning capabilities of known designs and configurations and none of the disadvantages.

It is another object of the present invention to provide a new and improved self-cleaning hairbrush system which may be easily and efficiently manufactured and marketed.

It is further object of the present invention to provide a new and improved self-cleaning hairbrush system which is of durable and reliable constructions.

An even further object of the present invention is to provide a new and improved self-cleaning hairbrush system which is susceptible of a low cost of manufacture with regard to both materials and labor, and which accordingly is then susceptible of low prices of sale to the consuming public, thereby making such self-cleaning hairbrush system economically available to the buying public.

Even still another object of the present invention is to provide a self-cleaning hairbrush system for automatically removing hair from the bristles of a hairbrush in a thorough and convenient manner.

Lastly, it is an object of the present invention to provide a new and improved self-cleaning hairbrush system having a housing with a wall formed with apertures and with a hollow interior with an open end and a closed end. A core has an interior end positionable adjacent to the closed end and an exterior exposed end extending through the open end of the housing. A plurality of resilient bristles have fixed ends extending radially outward from the core and free ends extending through the apertures of the housing. A handle is operatively coupled to the closed end of the housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the new and improved self cleaning hairbrush system constructed in accordance with the principles of the present invention.

FIG. 2 is a perspective view of the system shown in FIG. 1 but with the bristles retracted for effecting the cleaning of the system.

FIG. 3 is a cross sectional view taken along line 3—3 of FIG. 1.

FIG. 4 is a cross sectional view similar to FIG. 3 but with the bristles retracted.

FIG. 5 is a plan view of an alternate embodiment of the invention.

FIG. 6 is a cross sectional view taken along line 6—6 of FIG. 5.

FIG. 9 is a perspective illustration of the system shown in FIG. 1 but illustrating the system removably coupled to a handle with heating capabilities.

FIG. 10 is a perspective illustration of the system shown in FIG. 1 but illustrating the system removably coupled to a handle with blowing capabilities.

FIG. 11 is a cross sectional view of another alternate embodiment of the invention for incorporation into various hair care devices.

FIGS. 12 and 13 are cross sectional views of alternate embodiments formed of a twisted wire.

The same reference numerals refer to the same parts throughout the various Figures.

DESCRIPTION OF THE PREFERRED EMBODIMENT

Figure 7:
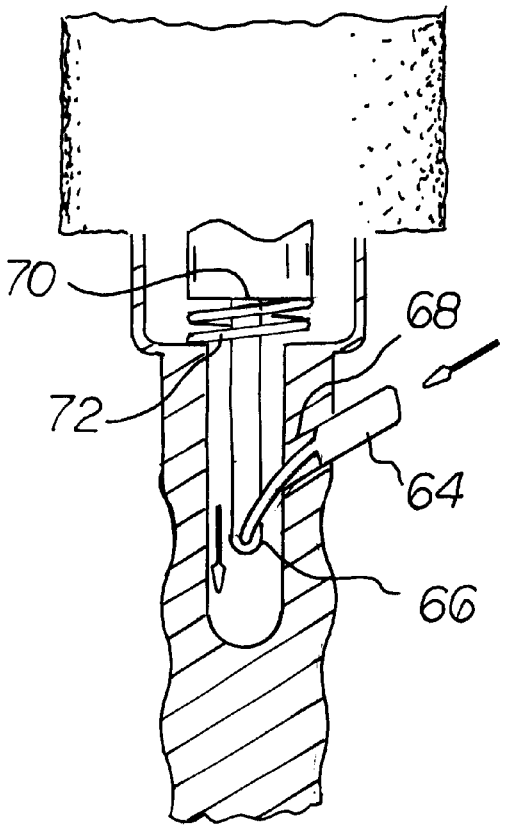
FIG. 7 is a cross sectional view similar to FIG. 6 but showing another alternate embodiment of the invention.

With reference now to the drawings, and in particular to FIG. 1 thereof, the preferred embodiment of the new and improved self-cleaning hairbrush system embodying the principles and concepts of the present invention and generally designated by the reference numeral 10 will be described.

The present invention, the self-cleaning hairbrush system 10 is comprised of a plurality of components. Such components in their broadest context include a housing, a core, and a plurality of bristles. Such components are individually configured and correlated with respect to each other so as to attain the desired objective.

First provided is a housing 12. The housing is fabricated of a rigid metallic material in a generally cylindrical configuration. The housing has a wall 14 formed with apertures 16 and has a hollow interior 18 with an open end 20 and a closed end 22. The closed end provides a circular abutment surface 24.

Next provided is a core 26. The core is shown as fabricated of a generally rigid material, preferably plastic, in a cylindrical configuration. A twisted metal wire could also be utilized. The core has an interior end 28 positionable adjacent to the abutment surface. The core also has an exterior exposed end 30 extending through the open end of the housing.

A plurality of resilient nylon bristles 32 are next provided. The bristles have fixed ends 34 extending radially outward from the core. The bristles also have free ends 36 extending through the apertures of the housing for use in brushing a person's hair or an animal's hair.

Next provided is a coil spring 38. The coil spring is positioned within the housing, between the core and the abutment surface. The spring has an extended orientation wherein the bristles extend radially outwardly from the core and through the apertures of the housing. The spring has a compressed orientation achieved through the depression of the exterior exposed end of the core toward the housing. In this manner, the bristles are withdrawn through the apertures of the housing so that the extraneous hair and other matter located in the bristles will be stripped therefrom as the bristles are moved inwardly through the apertures and cleaned. This action will remove hair from the bristles and transfer other hair to the tips of the bristles so that it may be more easily removed. Return of the core and bristles may be achieved by a spring or the resilience of the bristles.

A handle 40 is next provided. The handle is coupled to the closed end of the housing and extends coaxially with the housing and core in a direction away from the core for being held by a user during operation and use. The handle has annular indentations 42 for facilitating the grasping thereof by a user. Other handle shapes could be utilized as for a novelty effect.

Finally, a styling tip 44 is provided. The styling tip is in a cone-shaped configuration with a free pointed end 46 and a cylindrical end 48. A cylindrical recess 50 is provided in the exterior end of the core for removable receipt of the tip.

In the embodiment of FIGS. 1–4, the free end of the core constitutes a mechanism to reciprocate the core from an operative orientation to a cleaning orientation toward the interior end of the housing. The coil spring located between the core and the closed end of the housing functions to return the core from the cleaning orientation to the operative orientation. It should be understood, however, that the bristles are preferably fabricated of a resilient material, preferably a plastic such as nylon, and can be used to return the core from the cleaning orientation to the operative orientation without the use of a coil spring. When no spring is utilized, the resilience of the bristles may be utilized to return the core and bristles to their initial orientation for brushing.

In the embodiment of FIGS. 5 and 6, the mechanism to reciprocate the core within the housing comprises an axially reciprocable button 54 extending through the housing. A linkage 56, preferably an L-shaped linkage, is pivotably secured to the interior of the housing with a first end 58 coupled to the button and a second end 60 coupled to the core. In this manner, depressing the button will pull the core toward the closed end of the housing and withdrawn the bristles through the apertures of the housing so that the extraneous hair and other matter located in the bristles will be stripped therefrom as the bristles are moved inwardly through the apertures and cleaned.

In the FIG. 7 embodiment, the mechanism to reciprocate the core is within the housing and comprises a reciprocable button 64 extending angularly through the housing and a two bar linkage 66 within the interior of the housing. The linkage has a first end 68 coupled to the button and a second end 70 coupled to the core. In this manner, depressing the button will pull the core toward the closed end of the housing and withdraw the bristles through the apertures of the housing so that the extraneous hair and other matter located in the bristles will be stripped therefrom as the bristles are moved inwardly through the apertures and cleaned. This embodiment preferably also includes a coil spring 72 between the core and the closed end of the housing to return the core from the cleaning orientation to the operative orientation. Here again the spring could be eliminated as discussed above.

Figure 8:
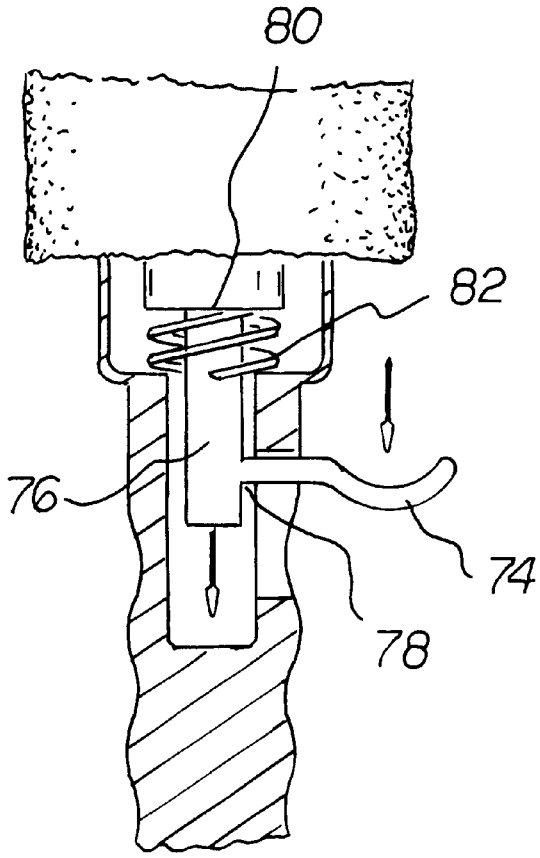
FIG. 8 is a cross sectional view similar to FIGS. 6 and 7 showing yet another alternate embodiment of the invention.

The FIG. 8 embodiment also has a mechanism to reciprocate the core within the housing. Such mechanism comprises an axially reciprocable trigger 74 extending radially through the housing and a fixed linkage 76 within the interior of the housing. Such mechanism includes a first end 78 coupled to the button and a second end 80 coupled to the core. In this manner sliding the trigger will pull the core toward the closed end of the housing and withdraw the bristles through the apertures of the housing so that the extraneous hair and other matter located in the bristles will be stripped therefrom as the bristles are moved inwardly through the apertures and cleaned. This embodiment preferably also includes a coil spring 82 between the core and the closed end of the housing to return the core from the cleaning orientation to the operative orientation. Here again the spring could be eliminated as discussed above.

In the embodiment of FIG. 9, the handle 86 is separably joined to the housing. Such embodiment further includes a heater 88 operatively associated with the handle and the housing. Additionally, an operator controlled button 90 is located on the handle for activating and inactivating the heater.

In the embodiment of FIG. 10, the handle 94 is separably joined to the housing. Such embodiment further includes a blower 96 operatively associated with the handle and the housing. Additionally, an operator controlled switch 98 is located on the handle for activating and inactivating the blower.

Another embodiment is shown in FIG. 11. In this embodiment, a mechanism to reciprocate the core within the housing is provided. The mechanism comprises an axially reciprocable button 104 extending through the housing. A motor 102 is secured to the interior of the housing. In this manner depressing the button will activate the motor and pull the core toward the closed end of the housing to a fixed distance and withdraw the bristles through the apertures of the housing so that the extraneous hair and other matter located in the bristles will be stripped therefrom as the bristles are moved inwardly through the apertures and cleaned. This action will remove some hair from the bristles and transfer other hair to the tips of the bristles so that it may be more easily removed. Return of the core and bristles may be achieved by a spring or the resilience of the bristles. It should also be appreciated that the core could be arranged within the housing whereby cleaning is achieved by its motion in either axial direction, whether towards the handle or away from the handle.

Another embodiment is shown in FIG. 12. In this embodiment, the core is fabricated as a twisted wire 108. The twisted wire retains the bristles 110. A reciprocable cap 112 supports the exposed end of the core. A collar 114 is removably received by the open end of the housing. The collar has an aperture 116 for the passage of the cap there through.

A final embodiment is shown in FIG. 13. As in the immediately preceding embodiment, the core is fabricated as a twisted wire 108, the twisted wire retains the bristles 110, a reciprocable cap 112 supports the exposed end of the core, a collar 114 is removably received by the open end of the housing, and the collar has an aperture 116 for the passage of the cap there through. Additionally, in this embodiment, a washer 118 is attached to the twisted wire adjacent to the interior end. Finally, in this embodiment, a coil spring 120 is provided between the closed end of the housing and the washer.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A self-cleaning hairbrush system comprising, in combination:

a housing fabricated of a rigid metallic material in a generally cylindrical configuration with a wall formed with apertures and with a hollow interior with an open end and a closed end with the closed end providing a circular abutment surface;

a core fabricated of a generally rigid plastic material in a cylindrical configuration having an interior end positionable adjacent to the abutment surface and having an exterior exposed end extending through the open end of the housing;

a plurality of resilient nylon bristles having fixed ends extending radially outward from the core and free ends extending through the apertures of the housing for use in brushing hair;

an optional coil spring positioned within the housing, between the core and the abutment surface, the spring having an extended orientation wherein the bristles extend radially outwardly from the core and through the apertures of the housing, the spring having a compressed orientation achieved through the depression of the exterior exposed end of the core toward the housing whereby the bristles are withdrawn through the apertures of the housing so that the extraneous hair and other matter located in the bristles will be stripped therefrom as the bristles are moved inwardly through the apertures and cleaned;

a handle coupled to the closed end of the housing and extending coaxially with the housing and core in a direction away from the core for being held by a user during operation and use; and a styling tip in a cone-shaped configuration with a free pointed end and a cylindrical end, and with a cylindrical recess in the exterior end of the core for removable receipt of the tip.

2. A self-cleaning hairbrush system comprising:

a housing with a wall formed with apertures and with a hollow interior with an open end and a closed end;

a core having an interior end positionable adjacent to the closed end and having an exterior exposed end extending through the open end of the housing;

a plurality of resilient bristles having fixed ends extending radially outward from the core and free ends extending through the apertures of the housing; and a handle operatively coupled to the closed end of the housing.

3. The system as set forth in claim 2 and further including a mechanism to reciprocate the core from an operative orientation to a cleaning orientation and an optional coil spring between the core and the closed end of the housing to return the core from the cleaning orientation to the operative orientation.

4. The system as set forth in claim 2 and further including a mechanism to reciprocate the core from an operative orientation to a cleaning orientation toward the interior end of the housing and the bristles are resilient nylon to return the core from the cleaning orientation to the operative orientation.

5. The system as set forth in claim 2 and further including a mechanism to reciprocate the core within the housing, the mechanism comprising an axially reciprocable button extending through the housing and a linkage pivotably secured to the interior of the housing with a first end coupled to the button and a second end coupled to the core whereby depressing the button will pull the core toward the closed end of the housing and withdraw the bristles through the apertures of the housing so that the extraneous hair and other matter located in the bristles will be stripped therefrom as the bristles are moved inwardly through the apertures and cleaned.

6. The system as set forth in claim 2 and further including a mechanism to reciprocate the core within the housing, the mechanism comprising a reciprocable button extending angularly through the housing and a two bar linkage within the interior of the housing with a first end coupled to the button and a second end coupled to the core whereby depressing the button will pull the core toward the closed end of the housing and withdrawn the bristles through the apertures of the housing so that the extraneous hair and other matter located in the bristles will be stripped therefrom as the bristles are moved inwardly through the apertures and cleaned.

7. The system as set forth in claim 2 and further including an optional coil spring between the core and the closed end of the housing to return the core from the cleaning orientation to the operative orientation.

8. The system as set forth in claim 2 and further including a mechanism to reciprocate the core within the housing, the mechanism comprising an axially reciprocable trigger extending radially through the housing and a fixed linkage within the interior of the housing with a first end coupled to the button and a second end coupled to the core whereby sliding the trigger will pull the core toward the closed end of the housing and withdrawn the bristles through the apertures of the housing so that the extraneous hair and other matter located in the bristles will be stripped therefrom as the bristles are moved inwardly through the apertures and cleaned.

9. The system as set forth in claim 7 and further including an optional coil spring between the core and the closed end of the housing to return the core from the cleaning orientation to the operative orientation.

10. The system as set forth in claim 2 wherein the handle is separably joined to the housing and further including a heater operatively associated with the handle and the housing with an operator controlled button on the handle for activating and inactivating the heater.

11. The system as set forth in claim 2 wherein the handle is separably joined to the housing and further including a blower operatively associated with the handle and the housing with an operator controlled switch on the handle for activating and inactivating the heater.

12. The system as set forth in claim 2 and further including additional hair styling components.

13. The system as set forth in claim 2 and further including a mechanism to reciprocate the core within the housing, the mechanism comprising an axially reciprocable button extending through the housing and a motor secured to the interior of the housing whereby depressing the button will activate the motor and pull the core toward the closed end of the housing and withdraw the bristles through the apertures of the housing so that the extraneous hair and other matter located in the bristles will be stripped therefrom as the bristles are moved inwardly through the apertures and cleaned.

14. The system as set forth in claim 2 wherein the core is fabricated as a twisted wire retaining the bristles and with a reciprocable cap supporting the exposed end of the core and a collar removably received by the open end of the housing, the collar having an aperture for the passage of the cap therethrough.

15. The system as set forth in claim 2 wherein the core is fabricated as a twisted wire retaining the bristles and with a reciprocable cap supporting the exposed end of the core and a collar removably received by the open end of the housing, the collar having an aperture for the passage of the cap there through and a washer attached to the twisted wire adjacent to the interior end and a coil spring between the closed end of the housing and the washer.

* * * * *